US011002467B2

(12) United States Patent
Wada et al.

(10) Patent No.: US 11,002,467 B2
(45) Date of Patent: May 11, 2021

(54) REFRIGERATION CYCLE APPARATUS

(71) Applicant: Mitsubishi Electric Corporation, Tokyo (JP)

(72) Inventors: Makoto Wada, Tokyo (JP); Takuya Matsuda, Tokyo (JP); Yuji Motomura, Tokyo (JP); Katsuhiro Ishimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/331,805

(22) PCT Filed: Oct. 25, 2016

(86) PCT No.: PCT/JP2016/081639
§ 371 (c)(1),
(2) Date: Mar. 8, 2019

(87) PCT Pub. No.: WO2018/078729
PCT Pub. Date: May 3, 2018

(65) Prior Publication Data

US 2019/0368782 A1 Dec. 5, 2019

(51) Int. Cl.
*F25B 49/02* (2006.01)
*F25B 43/00* (2006.01)
*F25B 1/00* (2006.01)

(52) U.S. Cl.
CPC ..... *F25B 1/00* (2013.01); *F25B 49/02* (2013.01); *F25B 43/00* (2013.01);
(Continued)

(58) Field of Classification Search
CPC ..... F25B 2400/19; F25B 2313/0233; F25B 2500/221; F25B 2500/222; F25B 2500/22; F25B 4/043
See application file for complete search history.

(56) References Cited

U.S. PATENT DOCUMENTS 6,425,257 B1 7/2002 Ohseki et al.
2004/0093893 A1* 5/2004 Tanimoto ..... F25B 49/025 62/510
(Continued)

FOREIGN PATENT DOCUMENTS

CN 104792071 A 7/2015
EP 3 040 655 A1 7/2016
(Continued)

OTHER PUBLICATIONS

Office Action dated Mar. 24, 2020 issued in corresponding JP patent application No. 2018-546977 (and English translation).
(Continued)

*Primary Examiner* — Cassey D Bauer
(74) *Attorney, Agent, or Firm* — Posz Law Group, PLC

(57) ABSTRACT

A refrigeration cycle apparatus capable of performing pump down operation while suppressing degradation in performance is provided. The refrigeration cycle apparatus includes an outdoor heat exchanger, a compressor including an inlet side and an outlet side, at least one indoor heat exchanger, a four-way valve, a check valve including an inlet side and an outlet side, a pipe serving as a first flow path connecting the outlet side of the check valve to the inlet side of the compressor, a first on-off valve, and a refrigerant leak detection device. The refrigeration cycle apparatus is configured such that, when a refrigerant leak is detected by the refrigerant leak detection device, pump down operation is performed as refrigerant transfer operation of transferring the refrigerant from the indoor heat exchanger to the outdoor heat exchanger.

6 Claims, 5 Drawing Sheets

(52) U.S. Cl.
CPC ..... *F25B 2400/19* (2013.01); *F25B 2500/222* (2013.01); *F25B 2700/00* (2013.01)

(56) References Cited

U.S. PATENT DOCUMENTS

| | | | | |
|---|---|---|---|---|
| 2010/0280669 | A1* | 11/2010 | Wycoff | F25B 41/062 700/282 |
| 2014/0373564 | A1* | 12/2014 | Nishimura | F25B 39/028 62/222 |
| 2015/0034293 | A1* | 2/2015 | Takayama | F25B 25/005 165/207 |

FOREIGN PATENT DOCUMENTS

| | | | | |
|---|---|---|---|---|
| JP | S53-059953 | A | 5/1978 | |
| JP | H01-314866 | A | 12/1989 | |
| JP | H2-140574 | A | 5/1990 | |
| JP | H05-118720 | A | 5/1993 | |
| JP | 2002-061996 | A | 2/2002 | |
| JP | 2002-228281 | A | 8/2002 | |
| JP | 2005-233505 | A | 9/2005 | |
| JP | 2010-156524 | A | 7/2010 | |
| JP | 2015-094574 | A | 5/2015 | |
| JP | 2015-105813 | A | 6/2015 | |
| WO | WO2015/064172 | * | 5/2015 | F25B 49/02 |

OTHER PUBLICATIONS

Extended European Search Report dated Oct. 4, 2019 issued in corresponding EP patent application No. 16920180.3.
International Search Report of the International Searching Authority dated Jan. 24, 2017 for the corresponding international application No. PCT/JP2016/081639 (and English translation).
Office Action dated May 28, 2020 issued in corresponding patent application No. 201680090242.1 (and English translation).
Office Action dated Sep. 23, 2020 issued in corresponding JP patent application No. 2018-546977 (and English translation).
Extended European Search Report dated Jan. 13, 2021 issued in corresponding EP patent application No. 16920180.3.
Office Action dated Feb. 16, 2021 issued in corresponding JP patent application No. 2020-017424 (and English machine translation).
Office Action dated Mar. 12, 2021 issued in corresponding CN patent application No. 201680090242.1 (and English machine translation).

* cited by examiner

REFRIGERATION CYCLE APPARATUS

CROSS REFERENCE TO RELATED APPLICATION

This application is a U.S. national stage application of International Application PCT/JP2016/081639, filed on Oct. 25, 2016, the contents of which are incorporated herein by reference.

TECHNICAL FIELD

The present invention relates to refrigeration cycle apparatuses, and more particularly to a refrigeration cycle apparatus configured to perform pump down operation when a refrigerant leak occurs.

BACKGROUND

Pump down operation is an operation intended to transfer refrigerant in an indoor unit and in pipes between the indoor unit and an outdoor unit into the outdoor unit by operating a compressor by closing a liquid shutoff valve. Generally, the pump down operation is often performed in existing equipment at the time of renewal or relocation of an air conditioner and a refrigerator.

Japanese Patent Laying-Open No. 5-118720 (PTL 1) discloses a refrigeration apparatus that minimizes the amount of refrigerant released into the room or into the atmosphere when a refrigerant leak occurs due to a failure of the refrigeration apparatus. This refrigeration apparatus is provided with a leak detection device for detecting a refrigerant leak, and on-off valves at portions of two pipes connecting an indoor unit and an outdoor unit. In this refrigeration apparatus, pump down operation is performed when the leak detection device detects a refrigerant leak. In the pump down operation, one of the on-off valves provided at portions of the pipes is closed first, and the other on-off valve is closed after refrigerant recovery operation has been performed.

PATENT LITERATURE

PTL 1: Japanese Patent Laying-Open No. 5-118720

However, the two on-off valves disposed at portions of the two pipes described above, which are required to perform the pump down operation as described above, are not required during normal operation, and are generally not installed. The installation of such on-off valves may cause an increase in flow path resistance of the pipes, resulting in degraded performance of a refrigeration cycle apparatus.

SUMMARY

An object of the present invention is to provide a refrigeration cycle apparatus capable of performing pump down operation while suppressing degradation in performance.

A refrigeration cycle apparatus according to the present embodiment includes an outdoor heat exchanger, a compressor including an inlet side and an outlet side, at least one indoor heat exchanger, a four-way valve, a check valve including an inlet side and an outlet side, a first flow path connecting the outlet side of the check valve to the inlet side of the compressor, a first on-off valve, and a refrigerant leak detection device. The refrigerant leak detection device is configured to detect a refrigerant leak from a refrigerant circuit. The refrigerant circuit is configured to cause at least refrigerant to circulate through the compressor, the outdoor heat exchanger, the first on-off valve, the at least one indoor heat exchanger, the four-way valve, and the check valve. The refrigerant circuit is configured, by operation of the four-way valve, such that the refrigerant circulates successively through the compressor, the outdoor heat exchanger, the first on-off valve, the at least one indoor heat exchanger, the check valve, and the first flow path in a cooling operation state. The refrigerant circuit is also configured such that the refrigerant circulates successively through the compressor, the at least one indoor heat exchanger, the first on-off valve, the outdoor heat exchanger, the check valve, and the first flow path in a heating operation state. The refrigeration cycle apparatus is configured such that, when a refrigerant leak is detected by the refrigerant leak detection device, refrigerant transfer operation of transferring the refrigerant from the indoor heat exchanger to the outdoor heat exchanger is performed. In the refrigerant transfer operation, when the refrigerant leak is detected by the refrigerant leak detection device in the cooling operation state, the compressor is operated with the first on-off valve being closed. In the refrigerant transfer operation, when the refrigerant leak is detected by the refrigerant leak detection device in the heating operation state, the compressor is operated with the first on-off valve being closed, after an operation state of the refrigerant circuit is changed from the heating operation state to the cooling operation state.

According to the above, since the check valve is disposed at the inlet side of the compressor, backflow of the refrigerant to the indoor unit can be suppressed by this check valve after the refrigerant has been transferred to the outdoor heat exchanger by the refrigerant transfer operation. In addition, the check valve increases flow path resistance of a pipe to a lesser extent than the on-off valve. Accordingly, a refrigeration cycle apparatus can be obtained that is capable of performing refrigerant transfer operation, that is, pump down operation, without causing degradation in performance resulting from an increase in flow path resistance.

DETAILED DESCRIPTION

Figure 1:
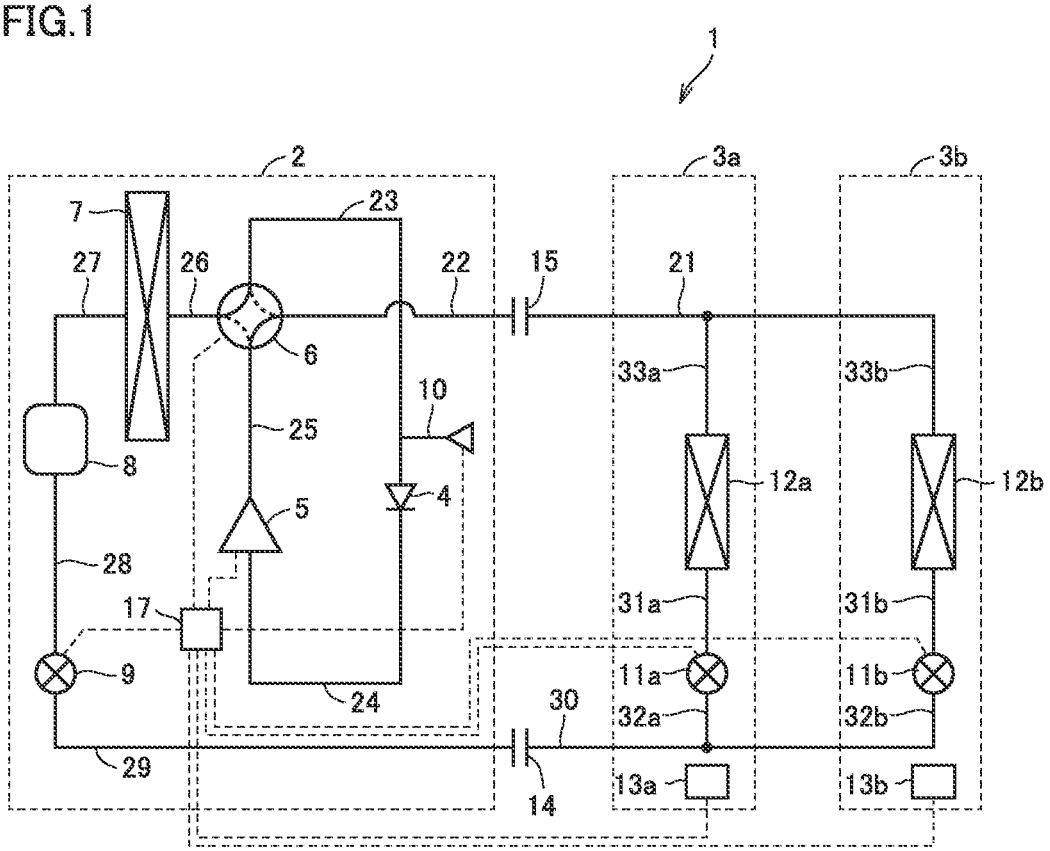
FIG. 1 shows a refrigerant circuit of a refrigeration cycle apparatus according to a first embodiment.

In the following, embodiments of the present invention will be described in detail with reference to the drawings. Although a plurality of embodiments are described below, it has been intended from the time of filing of the present application to appropriately combine configurations described in the respective embodiments. The same or corresponding parts are designated by the same symbols in the drawings and will not be described repeatedly.

First Embodiment

<Configuration of Refrigeration Cycle Apparatus>

FIG. 1 shows a refrigerant circuit of a refrigeration cycle apparatus 1 according to a first embodiment. Refrigeration cycle apparatus 1 shown in FIG. 1 is an air conditioning apparatus, and includes an outdoor unit 2 and a plurality of indoor units 3*a*, 3*b*. Although two indoor units 3*a*, 3*b* are disclosed in FIG. 1, there may be three or more indoor units, or there may be one indoor unit. Outdoor unit 2 is connected to indoor units 3*a*, 3*b* by pipes 21, 30, 32*b*, 33*b*.

Outdoor unit 2 mainly includes a four-way valve 6, a check valve 4, a compressor 5, an outdoor heat exchanger 7, a high pressure receiver corresponding to a first receiver, a first on-off valve 9, a pressure sensor 10, and a controller 17. Indoor unit 3*a* mainly includes an indoor heat exchanger 12*a*, a second on-off valve 11*a*, and a refrigerant leak detection device 13*a*. Indoor unit 3*b* mainly includes an indoor heat exchanger 12*b*, a second on-off valve 11*b*, and a refrigerant leak detection device 13*b*. Each of first on-off valve 9 and second on-off valves 11*a*, 11*b* is an expansion valve, for example, a liner expansion valve (LEV). The degree of opening of each of first on-off valve 9 and second on-off valves 11*a*, 11*b* is controlled such that the valve is fully opened, performs SH (superheat) control, SC (subcool) control, or is closed, depending on a control signal received from controller 17 to be described later.

In outdoor unit 2, a first port of four-way valve 6 is connected to an inlet side of check valve 4 through a pipe 23. Pressure sensor 10 is installed at pipe 23. An outlet side of check valve 4 is connected to an inlet side of compressor 5 through a pipe 24 corresponding to a first flow path. An outlet side of compressor 5 is connected to a second port of four-way valve 6 through a pipe 25. The third port of four-way valve 6 is connected to outdoor heat exchanger 7 through a pipe 26. Outdoor heat exchanger 7 is connected to a high pressure receiver 8 through a pipe 27. High pressure receiver 8 is connected to first on-off valve 9 through a pipe 28. First on-off valve 9 is connected to a third on-off valve 14 through a pipe 29.

A fourth port of four-way valve 6 is connected to a fourth on-off valve 15 through a pipe 22. Four-way valve 6 is configured to switch between a state in which the first port is connected to the third port and a state in which the first port is connected to the fourth port. Four-way valve 6 is also configured to switch between a state in which the second port is connected to the third port and a state in which the second port is connected to the fourth port. As to the connection state of each port of four-way valve 6 in FIG. 1, the connection state indicated by dotted lines is a state during cooling operation, and the connection state indicated by solid lines is a state during heating operation. That is, during the cooling operation, the second port and the third port are connected and the first port and the fourth port are connected in four-way valve 6. During the heating operation, the first port and the third port are connected and the second port and the fourth port are connected in four-way valve 6.

In indoor unit 3*a*, second on-off valve 11*a* is connected to indoor heat exchanger 12*a* through a pipe 31*a*. Indoor heat exchanger 12*a* is connected to fourth on-off valve 15 through pipes 33*a*, 21. Second on-off valve 11*a* is connected to third on-off valve 14 through pipes 32*a*, 30. Refrigerant leak detection device 13*a* is installed within a casing of indoor unit 3*a*, for example.

In indoor unit 3*b*, second on-off valve 11*b* is connected to indoor heat exchanger 12*b* through a pipe 31*b*. Indoor heat exchanger 12*b* is connected to fourth on-off valve 15 through pipes 33*b*, 21. Second on-off valve 11*b* is connected to third on-off valve 14 through pipes 32*b*, 30. Refrigerant leak detection device 13*b* is installed within a casing of indoor unit 3*b*, for example. Depending on the type of refrigerant to be detected, any mechanism can be employed for the refrigerant leak detection devices (or refrigerant leak detectors) 13*a*, 13*b*. Here, stated from a different perspective, second on-off valves 11*a*, 11*b* are disposed at pipes 29, 30, 32*a*, 31*a*, 32*b*, 31*b* serving as a third flow path connecting first on-off valve 9 to at least one indoor heat exchangers 12*a*, 12*b*.

Controller 17 installed in outdoor unit 2 is connected to pressure sensor 10, compressor 5, first on-off valve 9, second on-off valves 11*a*, 11*b*, four-way valve 6, and refrigerant leak detection devices 13*a*, 13*b*. Controller 17 controls each device of outdoor unit 2 and indoor units 3*a*, 3*b* during pump down operation to be described later. It should be noted that controller 17 includes a CPU (Central Processing Unit), a memory, an input/output buffer and the like (neither shown). The control in controller 17 is not limited to processing by software, but can also be processed by dedicated hardware (electronic circuit).

<Action of Refrigeration Cycle Apparatus>

Refrigeration cycle apparatus 1 is configured to switch its operation state between a cooling operation state and a heating operation state. The action of refrigeration cycle apparatus 1 in each operation state is described below.

(1) Cooling Operation State

High-temperature and high-pressure gas refrigerant compressed at compressor 5 flows into the second port of four-way valve 6. In four-way valve 6, a flow path connecting the second port and the third port is formed as indicated by the dotted lines in FIG. 1. Thus, the gas refrigerant flows to outdoor heat exchanger 7 through pipe 26. Outdoor heat exchanger 7 serves as a condenser. The gas refrigerant is cooled at outdoor heat exchanger 7 by air blown by an outdoor fan not shown in the figure. Thus, the gas refrigerant undergoes a phase change into a two-phase refrigerant state in which gas refrigerant and liquid refrigerant are present in a mixed manner, or into a single-phase state of liquid refrigerant. Subsequently, the refrigerant flows in the refrigerant circuit through high pressure receiver 8 and first on-off valve 9 to indoor units 3*a*, 3*b*. The refrigerant that has flown to indoor units 3*a*, 3*b* flows to indoor heat exchangers 12*a*, 12*b* through second on-off valves 11*a*, 11*b*. Indoor heat exchangers 12*a*, 12*b* each serve as an evaporator. Thus, the liquid refrigerant in the refrigerant in indoor heat exchangers 12*a*, 12*b* is evaporated and gasified by air blown by an indoor fan (not shown). The gasified refrigerant flows into the fourth port of four-way valve 6 through pipes 33*a*, 33*b*, 21, 22. Since the fourth port and the first port have been connected in four-way valve 6 as described above, the gasified refrigerant returns from the first port to compressor 5 through pipe 23, check valve 4 and pipe 24. This cycle allows cooling operation of cooling indoor air.

(2) Heating Operation State

High-temperature and high-pressure gas refrigerant compressed at compressor 5 flows into the second port of four-way valve 6. In four-way valve 6, a flow path connecting the second port and the fourth port is formed as indicated by the solid lines in FIG. 1. Thus, the gas refrigerant that has passed through the fourth port of four-way valve 6 flows to indoor units 3*a*, 3*b* through pipe 22, fourth on-off valve 15 and pipe 21. The refrigerant that has flown to indoor units 3*a*, 3*b* passes through indoor heat exchangers 12*a*, 12*b* of respective indoor units 3*a*, 3*b*. Here, indoor heat exchangers 12*a*, 12*b* each serve as a condenser. Thus, the gas refrigerant in indoor heat exchangers 12*a*, 12*b* is cooled and liquefied by air supplied to indoor heat exchangers 12*a*, 12*b* by the indoor fan (not shown). In addition, air warmed by heat from the gas refrigerant in indoor heat exchangers 12*a*, 12*b* is supplied into a room to be heated.

The liquefied liquid refrigerant passes through second on-off valves 11*a*, 11*b* each of which is a linear expansion valve (LEV), to thereby enter a two-phase refrigerant state in which low-temperature and low-pressure gas refrigerant and liquid refrigerant are present in a mixed manner, and returns to the outdoor unit through pipes 32*a*, 32*b*, 30. Subsequently, the refrigerant that has entered a two-phase refrigerant state (also referred to as two-phase refrigerant) flows to outdoor heat exchanger 7 through first on-off valve 9 which is an expansion valve. Outdoor heat exchanger 7 serves as an evaporator. In outdoor heat exchanger 7, the two-phase refrigerant is heated by air blown by the outdoor fan (not shown). As a result, the now-gasified refrigerant flows into the third port of four-way valve 6. The third port and the first port are connected in four-way valve 6. Thus, the gas refrigerant supplied to the third port returns to compressor 5 through the first port, pipe 23, check valve 4 and pipe 24. This cycle allows heating operation of heating indoor air.

<Pump Down Operation in Cooling Operation State of Refrigeration Cycle Apparatus>

Figure 2:
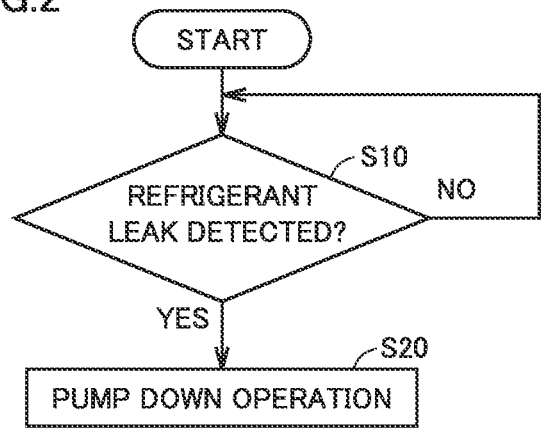
FIG. 2 is a flowchart illustrating action of the refrigeration cycle apparatus.
Figure 3:
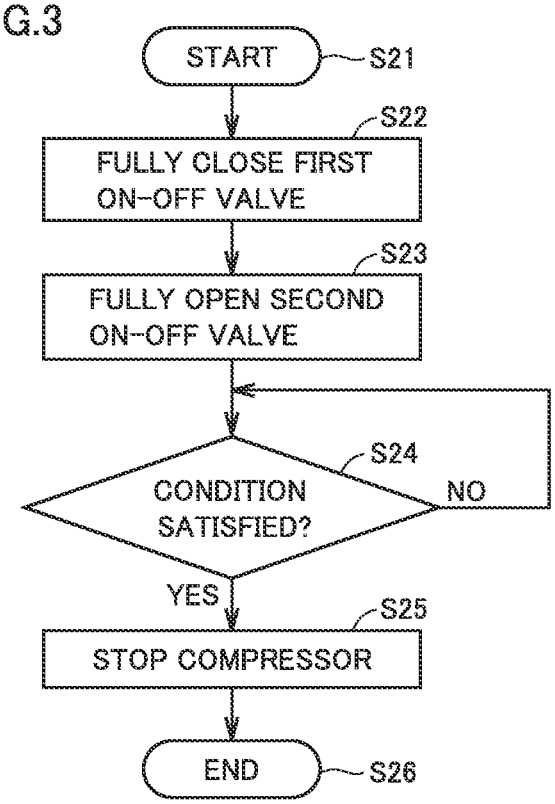
FIG. 3 is a flowchart illustrating pump down operation.

Referring now to FIGS. 2 and 3, pump down operation when a refrigerant leak is detected by one of refrigerant leak detection devices 13*a*, 13*b* in the above-described cooling operation state is described. FIG. 2 is a flowchart illustrating the pump down operation in refrigeration cycle apparatus 1 shown in FIG. 1. FIG. 3 is a flowchart illustrating specific action of a pump down operation step (S20) in FIG. 2 during the cooling operation. It should be noted that control with regard to the pump down operation as described below is performed by controller 17 controlling first on-off valve 9, second on-off valves 11*a*, 11*b*, compressor 5 and the like.

As shown in FIG. 2, in refrigeration cycle apparatus 1, a step of confirming whether a refrigerant leak has been detected (S10) is performed. When a refrigerant leak is not detected in this step (S10), this step (S10) is repeated at regular intervals, for example. A method of detecting a refrigerant leak may be such that, when a refrigerant leak is detected by refrigerant leak detection devices 13*a*, 13*b*, a signal is transmitted from refrigerant leak detection devices 13*a*, 13*b* to controller 17, for example.

When a refrigerant leak is detected in the step (S10), the pump down operation step (S20) is performed. In this step (S20), as shown in FIG. 3, after the pump down operation step is started (S21), a step of fully closing first on-off valve 9 (S22) is performed first. Specifically, first on-off valve 9 is fully closed by a control signal from controller 17. Next, a step of fully opening second on-off valves 11*a*, 11*b* (S23) is performed. Specifically, second on-off valves 11*a*, 11*b* are fully opened by a control signal from controller 17. The operation of compressor 5 is continued in this state. As a result, the refrigerant in indoor units 3*a*, 3*b* is transferred to outdoor unit 2. The transferred refrigerant cannot return to indoor units 3*a*, 3*b* through pipes 29, 30, because first on-off valve 9 has been fully closed. As a result, in outdoor unit 2, the refrigerant is accumulated in a refrigerant circuit portion from first on-off valve 9, pipe 28, high pressure receiver 8, pipe 27, outdoor heat exchanger 7, pipes 26, 25, compressor 5 to pipe 24. In addition, because check valve 4 is disposed, the refrigerant transferred to the outlet side of check valve 4 cannot return to the inlet side of check valve 4.

Next, a step of confirming whether a condition for stopping the pump down operation has been satisfied (S24) is performed. Any condition can be employed as the condition for stopping the pump down operation. Any condition can be used as this condition, as long as the condition indicates that the amount of refrigerant in indoor units 3*a*, 3*b* has reached an amount equal to or lower than a prescribed amount. For example, a condition that pressure at the inlet side of check valve 4 has reached a value equal to or lower than a prescribed value, or that a prescribed period of time has elapsed since the start of the pump down operation can be employed as this condition. The pressure at the inlet side of check valve 4 can be detected by pressure sensor 10, for example. In this step (S24), the confirmation of whether this condition has been satisfied is repeated until this condition is satisfied.

When it is confirmed in the step (S24) that the condition for stopping the pump down operation has been satisfied, a step of stopping the compressor (S25) is performed. In this step, the operation of compressor 5 is stopped by a control signal from controller 17. The pump down operation ends in this manner (S26).

<Pump Down Operation in Heating Operation State of Refrigeration Cycle Apparatus>

Figure 4:
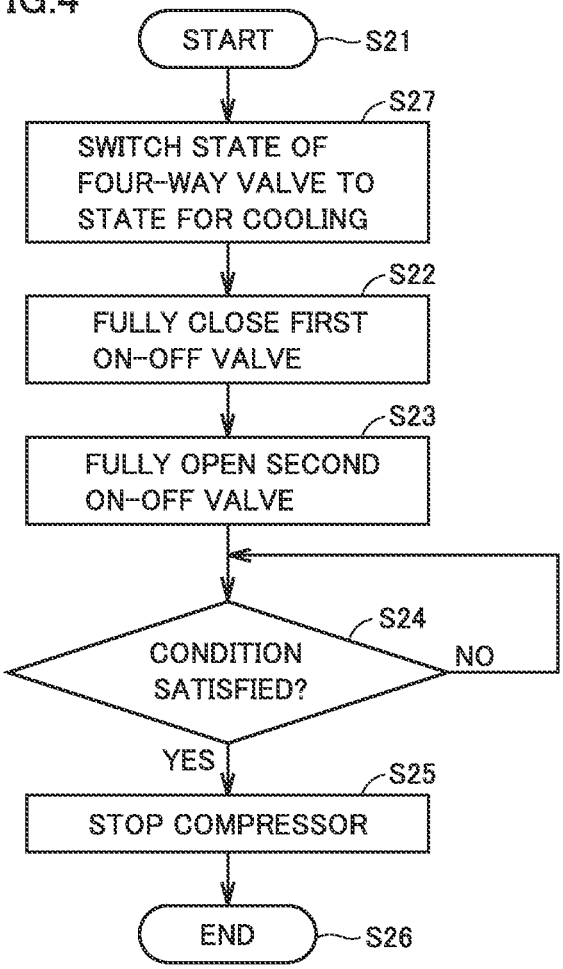
FIG. 4 is a flowchart illustrating pump down operation.

Referring now to FIGS. 2 and 4, pump down operation when a refrigerant leak is detected by one of refrigerant leak detection devices 13*a*, 13*b* in the above-described heating operation state is described. FIG. 4 is a flowchart illustrating specific action of the pump down operation step (S20) in FIG. 2 during the heating operation.

The step (S10) shown in FIG. 2 is similar to that during the cooling operation described above. Then, when a refrigerant leak is detected during the heating operation, the steps shown in FIG. 4 are performed as the pump down operation step (S20).

As shown in FIG. 4, in the pump down operation when a refrigerant leak is detected during the heating operation, a step of switching the state of the four-way valve to the state for cooling (S27) is performed first. Specifically, the internal flow path of four-way valve 6 is switched from the path indicated by the solid lines to the path indicated by the dotted lines in FIG. 1 by a control signal from controller 17.

Subsequently, the steps (S22) to (S26) are performed, as with the pump down operation in the cooling operation state.

<Function and Effect of Refrigeration Cycle Apparatus>

To summarize the configuration of refrigeration cycle apparatus 1 according to the present embodiment, refrigeration cycle apparatus 1 includes outdoor heat exchanger 7, compressor 5 including the inlet side and the outlet side, at least one indoor heat exchangers 12*a*, 12*b*, four-way valve 6, check valve 4 including the inlet side and the outlet side, pipe 24 serving as the first flow path connecting the outlet side of check valve 4 to the inlet side of compressor 5, first on-off valve 9, and refrigerant leak detection devices 13*a*, 13*b*. Refrigerant leak detection devices 13*a*, 13*b* are configured to detect a refrigerant leak from the refrigerant circuit. The refrigerant circuit is configured to cause at least refrigerant to circulate through compressor 5, outdoor heat exchanger 7, first on-off valve 9, at least one indoor heat exchangers 12*a*, 12*b*, four-way valve 6, and check valve 4. The refrigerant circuit is configured, by operation of four-way valve 6, such that the refrigerant circulates successively through compressor 5, outdoor heat exchanger 7, first on-off valve 9, at least one indoor heat exchangers 12*a*, 12*b*, check valve 4, and pipe 24 serving as the first flow path in the cooling operation state. The refrigerant circuit is also configured such that the refrigerant circulates successively through compressor 5, at least one indoor heat exchangers 12*a*, 12*b*, first on-off valve 9, outdoor heat exchanger 7, check valve 4, and pipe 24 serving as the first flow path in the heating operation state. Refrigeration cycle apparatus 1 is configured such that, when a refrigerant leak is detected by refrigerant leak detection devices 13*a*, 13*b*, pump down operation is performed as refrigerant transfer operation of transferring the refrigerant from indoor heat exchangers 12*a*, 12*b* to outdoor heat exchanger 7. In the pump down operation, when the refrigerant leak is detected by refrigerant leak detection devices 13*a*, 13*b* in the cooling operation state, compressor 5 is operated with first on-off valve 9 being closed. In the pump down operation, when the refrigerant leak is detected by refrigerant leak detection devices 13*a*, 13*b* in the heating operation state, compressor 5 is operated with first on-off valve 9 being closed, after the operation state of the refrigerant circuit is changed from the heating operation state to the cooling operation state.

As a result, when a refrigerant leak occurs, the pump down operation of transferring the refrigerant from indoor units 3*a*, 3*b* to outdoor unit 2 can be performed, to thereby reduce the amount of the refrigerant leak in the room. Moreover, the use of check valve 4 can reduce the possibility that the refrigerant transferred to outdoor unit 2 by the pump down operation will return to indoor units 3*a*, 3*b* through pipe 22 and the like, without installing an on-off valve at the inlet side of compressor 5. Moreover, an adverse increase in flow path resistance that occurs when an on-off valve is disposed at the inlet side of compressor 5 does not occur, so that degradation in performance of refrigeration cycle apparatus 1 caused by this increase in flow path resistance can be suppressed.

Refrigeration cycle apparatus 1 described above includes high pressure receiver 8 serving as the first receiver which is disposed at pipes 27, 28 serving as a second flow path connecting outdoor heat exchanger 7 to first on-off valve 9.

In refrigeration cycle apparatus 1 described above, at least one indoor heat exchangers 12*a*, 12*b* may include two or more heat exchangers. In this case, the plurality of indoor units 3*a*, 3*b* each having a heat exchanger mounted thereon are disposed. Such existence of the plurality of indoor units 3*a*, 3*b* increases the probability of a refrigerant leak in indoor units 3*a*, 3*b*. It is thus effective to employ refrigeration cycle apparatus 1 capable of performing the pump down operation according to the present embodiment.

Second Embodiment

<Configuration and Action of Refrigeration Cycle Apparatus>

Figure 5:
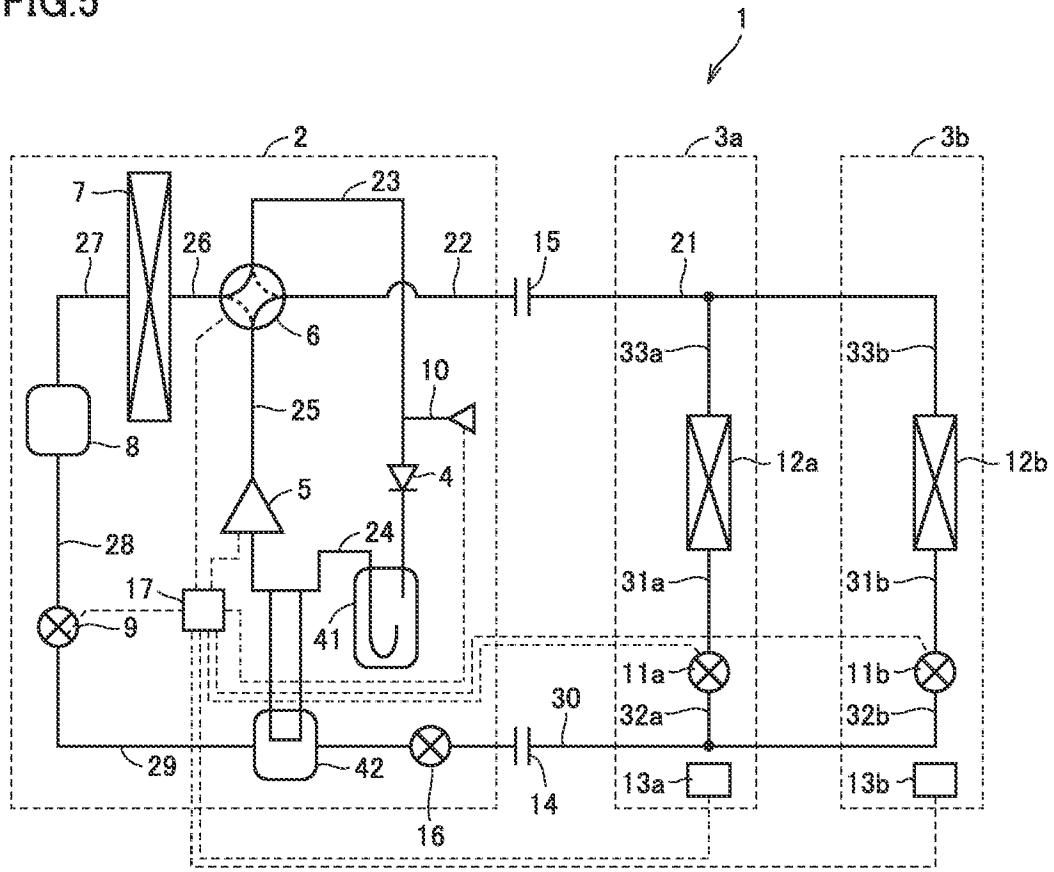
FIG. 5 shows a refrigerant circuit of a refrigeration cycle apparatus according to a second embodiment.

FIG. 5 shows a refrigerant circuit of refrigeration cycle apparatus 1 according to a second embodiment. Refrigeration cycle apparatus 1 shown in FIG. 5 is an air conditioning apparatus and basically has a similar configuration to that of refrigeration cycle apparatus 1 shown in FIG. 1, but is different from refrigeration cycle apparatus 1 shown in FIG. 1 in that it includes an accumulator 41, an intermediate pressure receiver 42 and a fifth on-off valve 16. Specifically, in refrigeration cycle apparatus 1 shown in FIG. 5, accumulator 41 is disposed at pipe 24 serving as the first flow path connecting the outlet side of check valve 4 to the inlet side of compressor 5. Intermediate pressure receiver 42 and fifth on-off valve 16 are disposed at pipe 29 forming the third flow path connecting first on-off valve 9 to at least one indoor heat exchangers 12*a*, 12*b*. Fifth on-off valve 16 is installed at a pipe connecting intermediate pressure receiver 42 to third on-off valve 14.

<Pump Down Operation of Refrigeration Cycle Apparatus>

Refrigeration cycle apparatus 1 shown in FIG. 5 can basically perform similar action to that of refrigeration cycle apparatus 1 shown in FIG. 1, and is configured to operate by switching between the cooling operation state and the heating operation state. The actions of the pump down operations in the cooling operation state and the heating operation state are also basically similar to those of refrigeration cycle apparatus 1 shown in FIG. 1.

<Function and Effect of Refrigeration Cycle Apparatus>

Refrigeration cycle apparatus 1 shown in FIG. 5 can basically obtain similar effects to those of refrigeration cycle apparatus 1 shown in FIG. 1. Moreover, refrigeration cycle apparatus 1 shown in FIG. 5, which has accumulator 41 disposed at the outlet side of check valve 4, can utilize this accumulator 41 as well for accumulating the refrigerant during the pump down operation. Accordingly, the amount of accumulated refrigerant in outdoor unit 2 during the pump down operation can be increased.

<Modification of Pump Down Operation of Refrigeration Cycle Apparatus>

Figure 6:
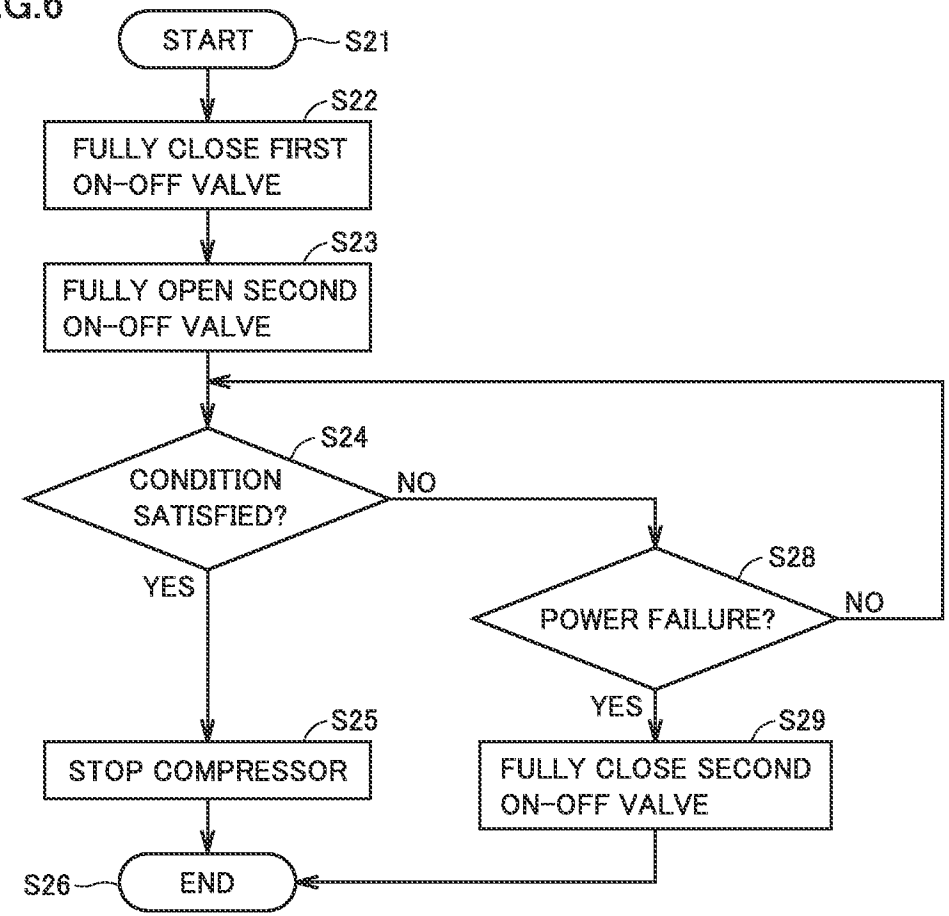
FIG. 6 is a flowchart illustrating a modification of the pump down operation.

FIG. 6 is a flowchart illustrating a modification of the pump down operation step (S20) in the cooling operation state shown in FIG. 3. The modification of the pump down operation step shown in FIG. 6 is basically similar to the steps shown in FIG. 3, and can obtain similar effects. Moreover, the modification of the pump down operation shown in FIG. 6 is characterized in that, when a power failure occurs during the pump down operation, control is performed such that a leak of the refrigerant, which has not been recovered from indoor units 3*a*, 3*b*, from indoor units 3*a*, 3*b* is suppressed. A specific description is given below.

When a refrigerant leak is detected in the step (S10) shown in FIG. 2 and the pump down operation step (S20) is performed, the step (S22), the step (S23) and the step (S24) are performed in the process shown in FIG. 6 as with the process shown in FIG. 3. Then, when the confirmation of whether the condition for stopping the pump down operation has been satisfied is repeated in the step (S24), and it is determined in the step (S24) that the condition has not been satisfied, then a step of determining whether a power failure has occurred (S28) is performed. In this step (S28), any method can be employed as a method of determining whether a power failure has occurred. For example, in the step (S28), whether a power failure has occurred is determined by a method of receiving an abnormality occurrence signal from a management system such as a facility where the refrigeration cycle apparatus has been installed.

Then, when it is determined in the step (S28) that a power failure has not occurred, the step (S24) is performed again. When it is determined in the step (S28) that a power failure has occurred, on the other hand, a step of fully closing second on-off valves 11*a*, 11*b* (S29) is performed. In this case, compressor 5 is also stopped due to the power failure. Thus, the process proceeds to the step (S26), where the process of the pump down operation shown in FIG. 6 ends.

Any method can be used as a method of fully closing second on-off valves 11*a*, 11*b*. For example, refrigeration cycle apparatus 1 may have an auxiliary power supply, and refrigeration cycle apparatus 1 may be configured to perform operation of fully closing second on-off valves 11*a*, 11*b* when a power failure occurs.

In this manner, refrigeration cycle apparatus 1 is configured to close second on-off valves 11*a*, 11*b* when a power failure occurs during the pump down operation. Thus, when compressor 5 is stopped due to a power failure or the like during the pump down operation, the refrigerant located in a refrigerant circuit portion from first on-off valve 9 to pipes 29, 30, 32*a*, 32*b* can be confined in this refrigerant circuit portion by fully closing second on-off valves 11*a*, 11*b*. As a result, the possibility of a leak of this refrigerant circuit portion from the indoor units 3*a*, 3*b* side can be reduced.

It should be noted that the step (S28) and the step (S29) of the process described above may be applied to the pump down operation steps in the heating operation state shown in FIG. 4.

It should be understood that the embodiments disclosed herein are illustrative and non-restrictive in every respect. The scope of the present invention is defined by the terms of the claims, not the description of the embodiments above, and is intended to include any modifications within the meaning and scope equivalent to the terms of the claims.

The invention claimed is:

1. A refrigeration cycle apparatus comprising:

an outdoor heat exchanger;

a compressor including an inlet side and an outlet side;

at least one indoor heat exchanger;

a four-way valve;

a check valve including an inlet side and an outlet side;

a flow path extending between and connecting the four-way valve to the inlet side of the check valve;

a pressure sensor connected to the flow path between the four-way valve and the inlet side of the check valve and configured to detect a pressure of the inlet side of the check valve;

a first flow path connecting the outlet side of the check valve to the inlet side of the compressor;

a first on-off valve; and a refrigerant leak detector configured to detect a refrigerant leak from a refrigerant circuit, the refrigerant circuit being configured to cause refrigerant to circulate through the compressor, the outdoor heat exchanger, the first on-off valve, the at least one indoor heat exchanger, the four-way valve, and the check valve, wherein the refrigerant circuit is configured, by operation of the four-way valve, such that the refrigerant circulates successively through the compressor, the outdoor heat exchanger, the first on-off valve, the at least one indoor heat exchanger the check valve, and the first flow path in a cooling operation state, and such that the refrigerant circulates successively through the compressor, the at least one indoor heat exchanger, the first on-off valve, the outdoor heat exchanger, the check valve, and the first flow path in a heating operation state, the refrigeration cycle apparatus is configured such that, when a refrigerant leak is detected by the refrigerant leak detector, refrigerant transfer operation of transferring the refrigerant from the at least one indoor heat exchanger to the outdoor heat exchanger is performed, and in the refrigerant transfer operation, when the refrigerant leak is detected by the refrigerant leak detector in the cooling operation state, the compressor is operated with the first on-off valve being closed, when the refrigerant leak is detected by the refrigerant leak detector in the heating operation state, the compressor is operated with the first on-off valve being closed, after an operation state of the refrigerant circuit is changed from the heating operation state to the cooling operation state, and when the pressure sensor detects an amount of refrigerant in a flow between the at least one indoor heat exchanger and the check valve via the four-way valve and the flow path equal to or lower than a prescribed amount, the refrigerant transfer operation is stopped.

2. The refrigeration cycle apparatus according to claim 1, comprising an accumulator installed in the first flow path.

3. The refrigeration cycle apparatus according to claim 1, comprising a receiver disposed in a second flow path connecting the outdoor heat exchanger to the first on-off valve.

4. The refrigeration cycle apparatus according to claim 1, wherein the at least one indoor heat exchanger comprises a plurality of indoor heat exchangers and the refrigerant cycle apparatus comprises a plurality of indoor units, wherein each of the plurality of indoor units has one of the plurality indoor heat exchangers respectively.

5. The refrigeration cycle apparatus according to claim 1, comprising a receiver disposed in another flow path connecting the first on-off valve to the at least one indoor heat exchanger.

6. The refrigeration cycle apparatus according to claim 1, comprising a second on-off valve disposed in another flow path connecting the first on-off valve to the at least one indoor heat exchanger, wherein the refrigeration cycle apparatus is configured to close the second on-off valve when a power failure occurs during the refrigerant transfer operation.

* * * * *